US010634368B2

(12) United States Patent
Kim et al.

(10) Patent No.: US 10,634,368 B2
(45) Date of Patent: Apr. 28, 2020

(54) CONTROL BOX, AND OUTDOOR UNIT OF AIR CONDITIONER COMPRISING SAME

(71) Applicant: Samsung Electronics Co., Ltd, Gyeonggi-do (KR)

(72) Inventors: Jong Tae Kim, Gyeonggi-do (KR); Min Wook Park, Seoul (KR); Yong Ho Lee, Gyeonggi-do (KR); Seong Hwan Jang, Gyeonggi-do (KR); Il Kwon Jung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 157 days.

(21) Appl. No.: 15/028,400

(22) PCT Filed: Oct. 8, 2014

(86) PCT No.: PCT/KR2014/009475
§ 371 (c)(1),
(2) Date: Apr. 8, 2016

(87) PCT Pub. No.: WO2015/053554
PCT Pub. Date: Apr. 16, 2015

(65) Prior Publication Data

US 2016/0258636 A1 Sep. 8, 2016

(30) Foreign Application Priority Data

Oct. 10, 2013 (KR) ..... 10-2013-0120318

(51) Int. Cl.
*F24F 1/24* (2011.01)
*F24F 13/20* (2006.01)
(Continued)

(52) U.S. Cl.
CPC ..... *F24F 1/24* (2013.01); *F24F 1/22* (2013.01); *F24F 1/38* (2013.01); *F24F 13/20* (2013.01)

(58) Field of Classification Search
CPC ..... F24F 1/22; F24F 1/24; F24F 1/38; F24F 13/20; F24F 2013/2056; H01L 23/46;
(Continued)

(56) References Cited

U.S. PATENT DOCUMENTS 7,277,282 B2 * 10/2007 Tate ..... G06F 1/20 165/104.21
2006/0227504 A1 * 10/2006 Chen ..... H01L 23/467 361/679.47
(Continued)

FOREIGN PATENT DOCUMENTS

CN 101680669 A 3/2010
CN 201476216 U 5/2010
(Continued)

OTHER PUBLICATIONS

Communication pursuant to Rule 164(1) EPC dated Jun. 16, 2017 in connection with European Patent Application No. 14852635.
(Continued)

*Primary Examiner* — Joseph F Trpisovsky

(57) ABSTRACT

The present invention relates to a control box and to an outdoor unit of an air conditioner comprising the same; the control box using a refrigerant cooling device and an air cooling device so as to radiate heat efficiently. The control box comprises: a case; a heat-radiating electronic component located inside the case; a refrigerant cooling device which is attached to one side of the case and makes contact with the electronic component so as to radiate heat to the outside; and an air cooling device which is attached to one side of the case and has a circulation fan for forcible circulating the air inside the case. Because the present
(Continued)

invention is provided both with the refrigerant cooling device and the air cooling device, the electronic component inside the control box can radiate heat efficiently.

4 Claims, 9 Drawing Sheets

(51) Int. Cl.
*F24F 1/22* (2011.01)
*F24F 1/38* (2011.01)

(58) Field of Classification Search
CPC . H01L 23/467; H01L 23/473; H05K 7/20218; H05K 7/20254; H05K 7/20263; H05K 7/20272; H05K 7/20409; H05K 7/20418; H05K 7/20436; H05K 7/20509; H05K 7/209; H05K 7/20909; H05K 7/20927
USPC ..... 62/259.2; 361/679.46, 679.47, 679.48, 361/676, 677, 678
See application file for complete search history.

(56) References Cited

U.S. PATENT DOCUMENTS

| | | | | |
|---|---|---|---|---|
| 2009/0178425 | A1* | 7/2009 | Tsuchiya | G06F 1/203 62/259.2 |
| 2011/0310550 | A1* | 12/2011 | Xu | G06F 1/20 361/679.33 |

FOREIGN PATENT DOCUMENTS

| | | | |
|---|---|---|---|
| CN | 102997345 | A | 3/2013 |
| JP | 06221622 | A | 8/1994 |
| JP | 2000-018646 | | 1/2000 |
| JP | 2007-285544 | | 11/2007 |
| JP | 2008002741 | A | 1/2008 |
| JP | 2010-002120 | A | 1/2010 |
| JP | 2012-127591 | | 7/2012 |
| KR | 10-2003-0055725 | | 7/2003 |
| KR | 20-0334432 | | 11/2003 |
| KR | 10-2007-0077917 | A | 7/2007 |

OTHER PUBLICATIONS

European Patent Office, "Supplementary European Search Report," Application No. EP 14 85 2635, dated Sep. 20, 2017, 9 pages.
International Search Report dated Jan. 23, 2015 in connection with International Application No. PCT/KR2014/009475, 5 pages.
Written Opinion of the International Searching Authority dated Jan. 23, 2015 in connection with International Application No. PCT/KR2014/09475, 7 pages.
The State Intellectual Property Office of the People's Republic of China First Office Action regarding Application No. 201480055869.4, dated Jun. 21, 2018, 21 pages.
Office Action dated Apr. 2, 2019 in connection with Chinese Patent Application No. 201480055869.4, 22 pages.
Intention to grant dated Jun. 18, 2019 in connection with European Patent Application No. 14 852 635.3, 32 pages.
Korean Intellectual Property Office, "Notice of Rejection," Application No. KR 10-2013-0120318, dated Jan. 23, 2020, 18 pages.
National Intellectual Property Administration, PRC, "The Third Office Action," Application No. CN 201480055869.4, dated Nov. 4, 2019, 6 pages.

* cited by examiner

[Fig. 1]
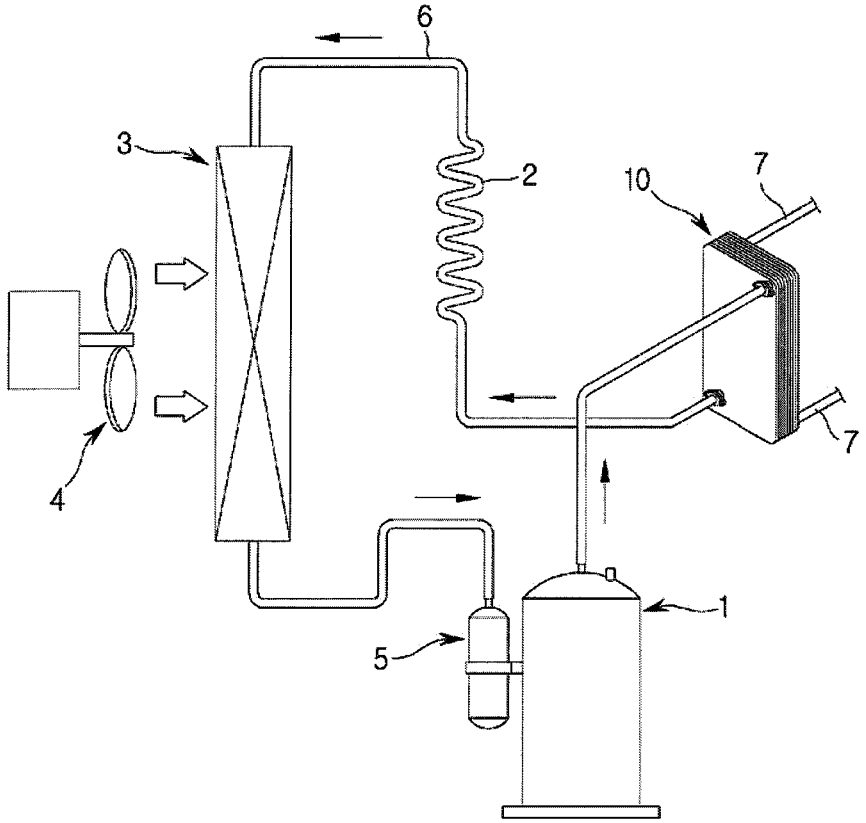

[Fig. 2]
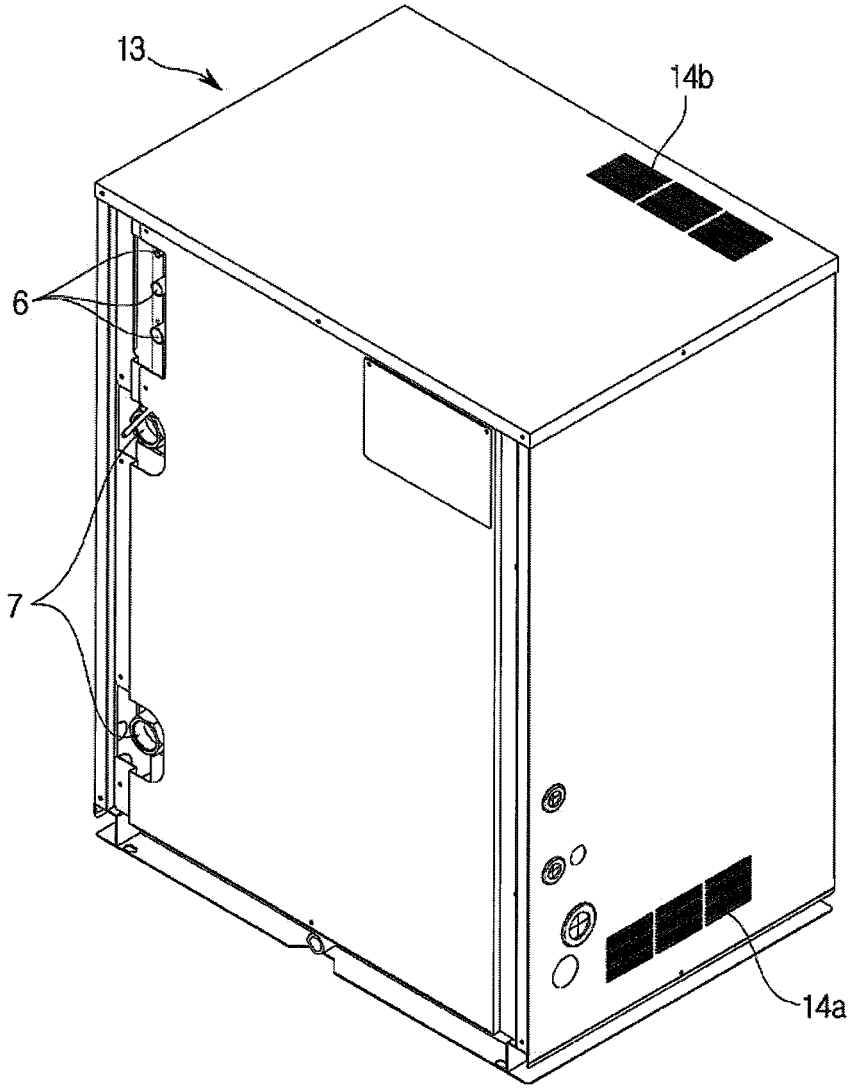

[Fig. 3]
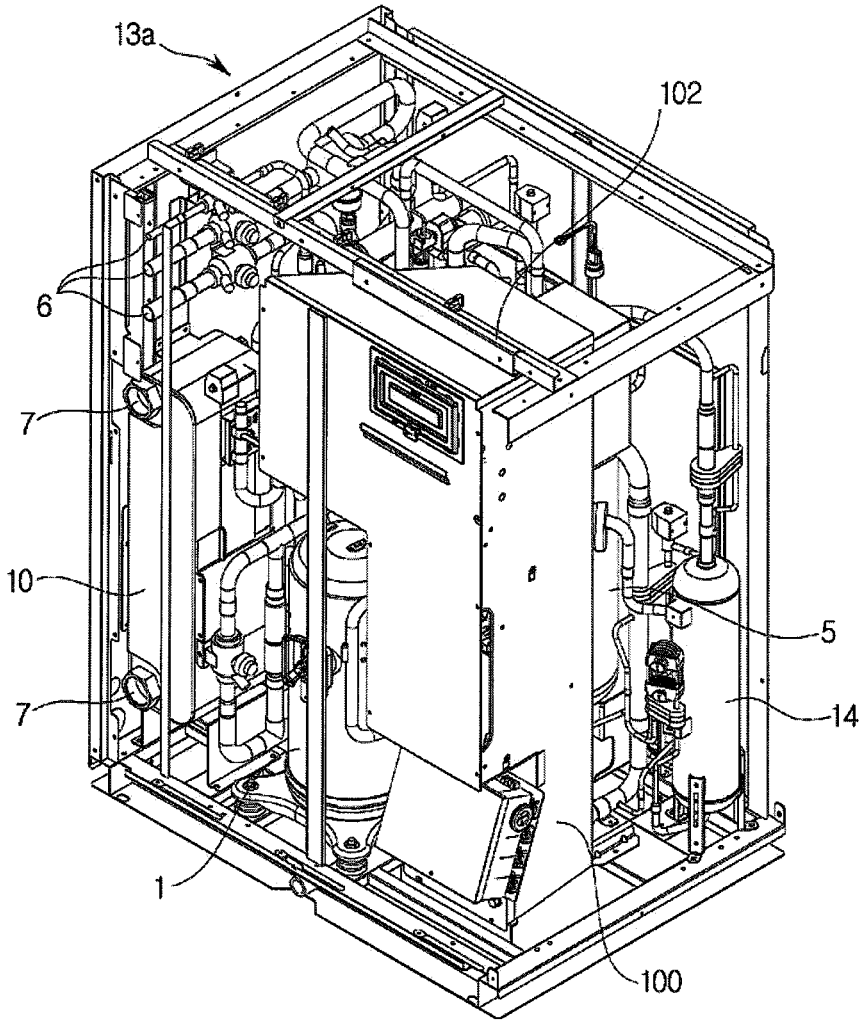

[Fig. 4]
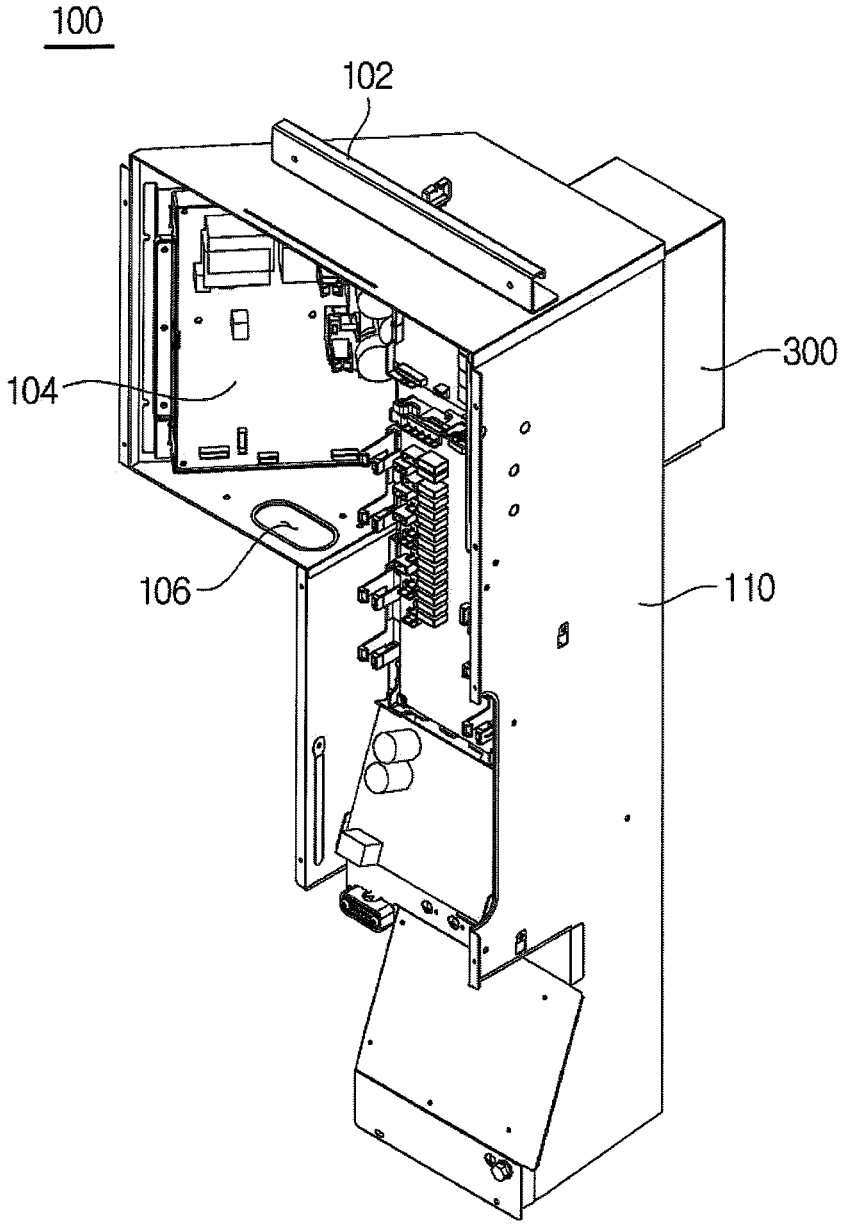

[Fig. 5]
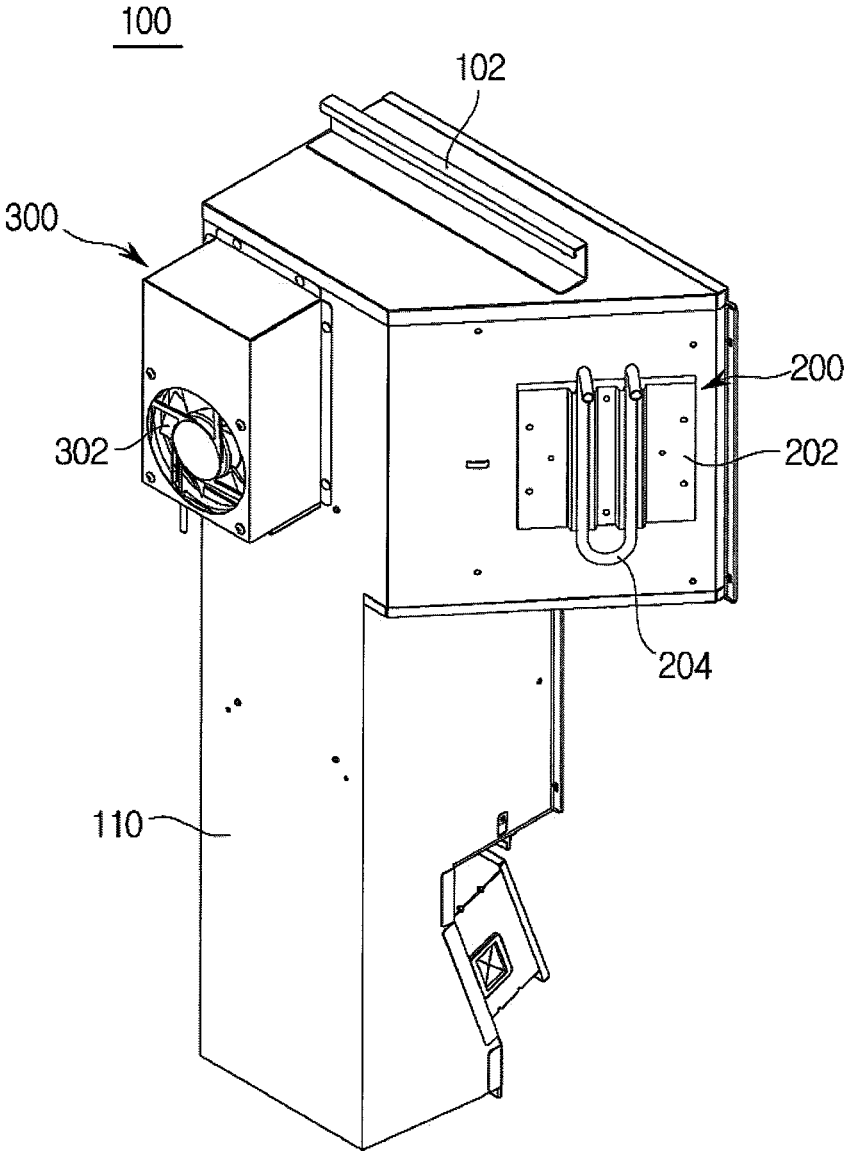

[Fig. 6]
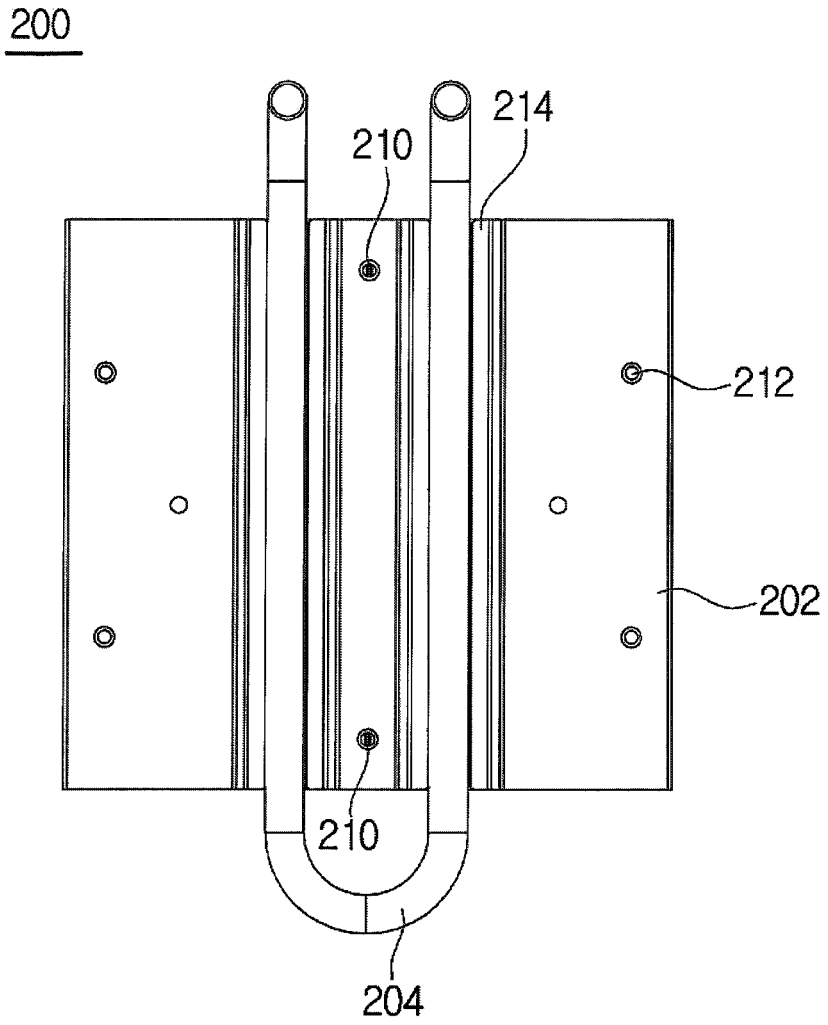

[Fig. 7]
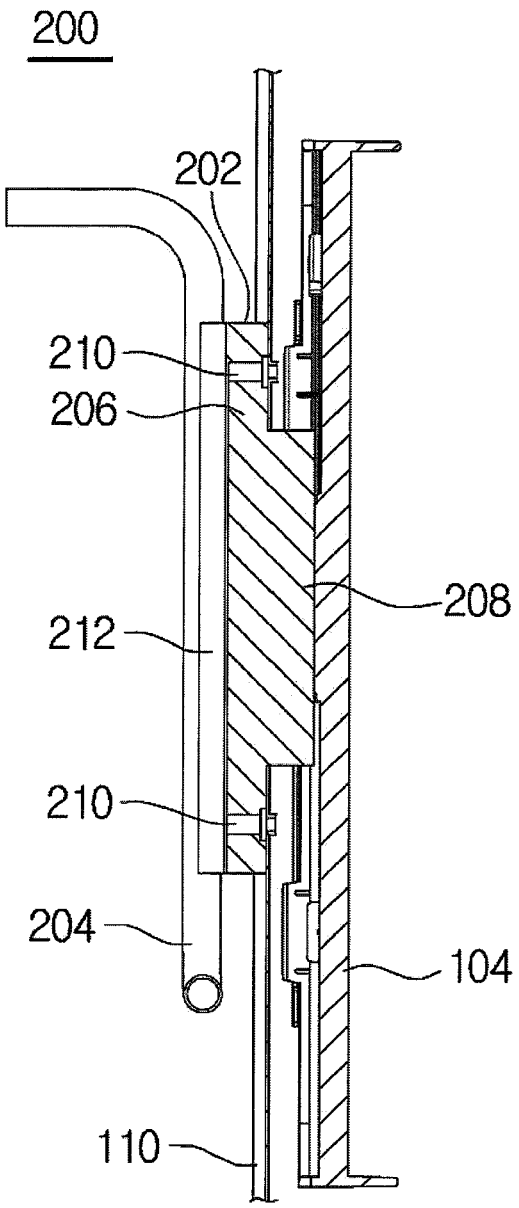

[Fig. 8]
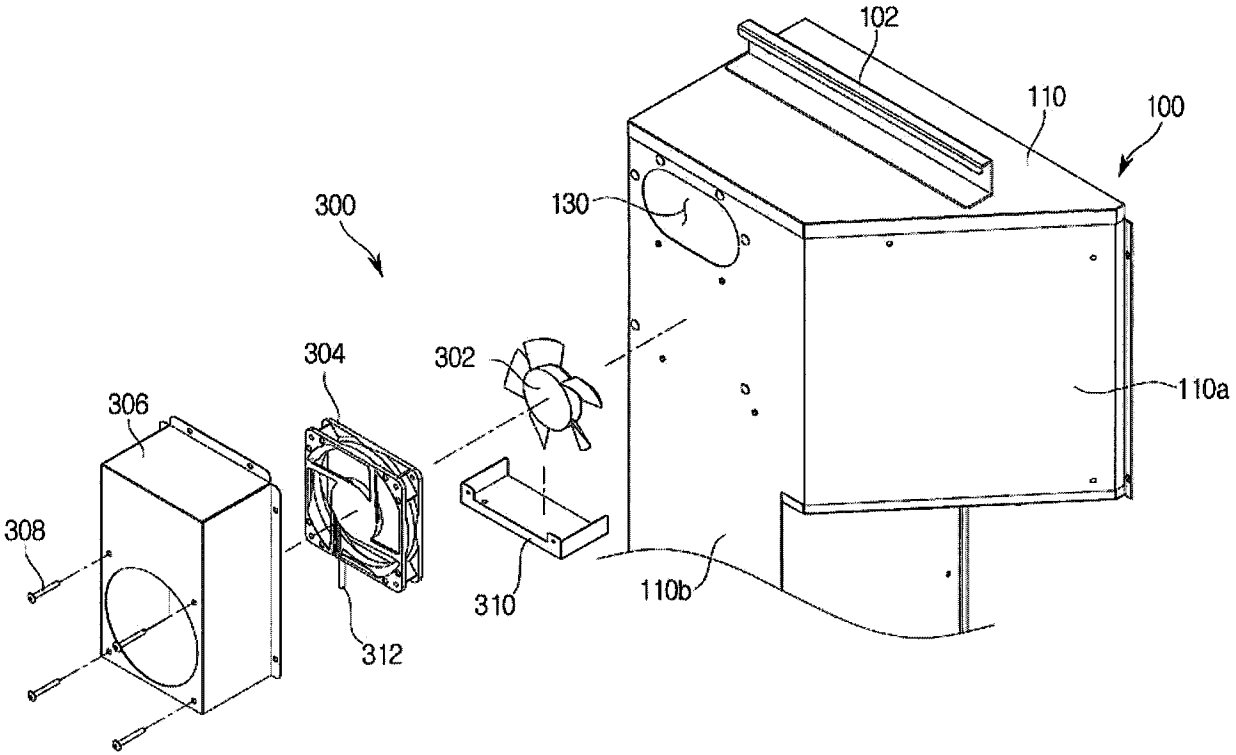

[Fig. 9]
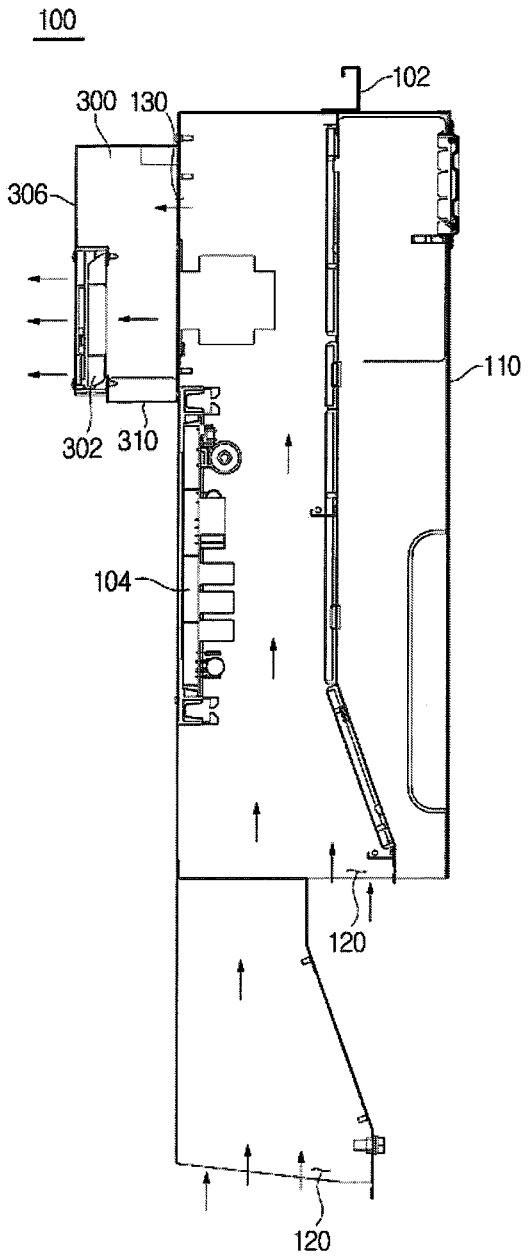

CONTROL BOX, AND OUTDOOR UNIT OF AIR CONDITIONER COMPRISING SAME

TECHNICAL FIELD

The present invention relates to a control box and an outdoor unit of an air conditioner having the same, and more particularly, to a control box which efficiently dissipates heat using a refrigerant cooling device and an air cooling device and an outdoor unit of an air conditioner including the same.

BACKGROUND ART

Generally, air conditioners are devices which control temperature, humidity, and the like, using a refrigeration cycle, and simultaneously remove particles and the like in air. The refrigeration cycle is constituted of main components such as a compressor, a condenser, an evaporator, a blower fan, and the like.

Air conditioners include an air-cooled air conditioner which condenses a refrigerant by cooling a heat exchanger serving as a condenser by air, and a water-cooled air conditioner which condenses a refrigerant by cooling a heat exchanger by water.

Since the air-cooled air conditioner has low heat exchange efficiency, the size of the heat exchanger should be great to obtain a sufficient cooling effect. In addition, there is a demerit in that a blower fan for forcibly blowing air is installed additionally.

On the contrary, since the water-cooled air conditioner which uses the water-cooled heat exchanger has high heat exchange efficiency, the water-cooled air conditioner may have a small heat exchanger. However, there is a demerit in that the heat exchanger is connected to a cooling water pipe and cooling water should be supplied continuously, and heat dissipation is difficult since the heat exchanger is installed in a sealed space.

Particularly, when a control box is installed in a sealed space like the water-cooled heat exchanger, there is a problem in that electrical components may not perform their own functions or their lifetimes are shortened due to self-heating. That is, the electrical components generate heat while operating the air conditioner, and the heat causes the malfunction of a device when the heat is not dissipated suitably.

DISCLOSURE

Technical Problem

The present invention is directed to providing a control box positioned in an enclosed housing and an efficient cooling structure installed in an air conditioner including the control box.

In addition, the present invention is directed to providing a control box which efficiently dissipates heat by installing both of a refrigerant cooling device and an air cooling device, and an air conditioner including the same.

Technical Solution

One aspect of the present invention provides a control box including a case, an electrical component positioned in the case and configured to heat, a refrigerant cooling device which is attached to one side of the case, contacts the electrical component, and dissipates heat to the outside, and an air cooling device attached to one side of the case and including a circulation fan which forcibly circulates internal air of the case.

The case may include at least one of an inlet and an outlet so that internal air circulates.

The at least one inlet may be positioned at a lower portion of the case, and the at least one outlet may be positioned at an upper portion of the case so that air flows in the lower portion of the case passes through an inside and flows out through the upper portion.

The refrigerant cooling device may include a heat dissipating plate which penetrates the case to directly contact the electrical component, and a refrigerant pipe coupled to the heat dissipating plate.

The heat dissipating plate may include a first portion which is disposed to directly contact the electrical component to absorb heat from the electrical component, and a second portion disposed at an outside of the case, and connected to the refrigerant pipe to dissipate heat.

The air cooling device may be disposed close to the at least one outlet.

The electrical component which generates heat may be positioned at an upper portion of the case, and the refrigerant cooling device and the air cooling device may be positioned at one side of the upper portion of the case to dissipate the heat of the electrical component.

Another aspect of the present invention provides a control box which is provided in a sealed inner space to control an operation of an outdoor unit of an air conditioner includes a plurality of electrical components installed therein, a circulation fan which forcibly circulates internal air of the control box to the outside, an inlet provided so that air flows into the control box by the circulation fan, an outlet provided so that the air which flows in through the inlet flows out to an outside of the control box, and a refrigerant pipe attached to an outer surface of the control box, wherein a refrigerant which circulates in the air conditioner flows through the refrigerant pipe.

The inlet may be positioned at a lower portion, and the outlet may be positioned at an upper portion so that the air flows in through the inlet moves from the lower portion to the upper portion and passes through the electrical components.

The control box may further include a heat dissipating plate configured to connect the refrigerant pipe and the electrical components.

Still another aspect of the present invention provides an outdoor unit of an air conditioner including a housing configured to form an exterior, a compressor which compresses a refrigerant gas and discharge the refrigerant gas, a condenser which performs heat exchange between the refrigerant gas discharged from the compressor and cooling water, and condenses the refrigerant gas into a liquid refrigerant, and a control box in which an electrical component configured to control the air conditioner is installed, wherein the control box includes a refrigerant cooling device which uses a refrigerant which circulates in the air conditioner to cool the electrical component, and an air cooling device which circulates internal air.

The housing may include at least one blowing port through which external air circulates.

The control box may include at least one of an inlet and an outlet so that air which circulates in the housing through the at least one blowing port circulates in the control box by the air cooling device.

The control box may be installed and fixed to one side in the housing.

The refrigerant cooling device may use the refrigerant gas from the compressor as a refrigerant.

Advantageous Effects

Heat of electrical components positioned in a control box can be effectively dissipated by installing both of a refrigerant cooling device and an air cooling device.

Electrical components are efficiently cooled by suitably adjusting refrigerant cooling and air cooling, and a space in which a cooling device is installed can be optimized.

DESCRIPTION OF DRAWINGS

FIG. 1 is a view illustrating a refrigerant cycle of an air conditioner according to one embodiment of the present invention.

FIGS. 2 and 3 are views illustrating an outdoor unit of the air conditioner according to one embodiment of the present invention.

FIGS. 4 and 5 are views illustrating a control box according to one embodiment of the present invention.

FIGS. 6 and 7 are views illustrating a refrigerant cooling device attached to the control box according to one embodiment of the present invention.

FIG. 8 is a view illustrating an air cooling device attached to the control box according to one embodiment of the present invention.

FIG. 9 is a view illustrating air flow in the control box according to one embodiment of the present invention.

MODES OF THE INVENTION

Hereinafter, embodiments of the present invention will be described in detail with reference to the accompanying drawings.

FIG. 1 is a view illustrating a refrigerant cycle of an air conditioner according to one embodiment of the present invention.

The refrigeration cycle operating in the air conditioner includes a compressor 1, a condenser, an expansion valve 2, and an evaporator. The refrigeration cycle circulates through a process having the sequence of compression, condensation, expansion, and evaporation, and conditioned air may be supplied into an interior after heat exchanging with the refrigerant.

The compressor 1 compresses a refrigerant gas to be in a high temperature and high pressure state and discharges the refrigerant gas, and the discharged refrigerant gas flows into the condenser. The condenser condenses the compressed refrigerant to be in a liquid state, and dissipates heat to its surroundings through condensation.

The expansion valve 2 expands the liquid refrigerant in a high temperature and high pressure state which is condensed by the condenser into a liquid refrigerant in a low pressure state. The evaporator evaporates the refrigerant expanded by the expansion valve 2. The evaporator achieves a refrigeration effect by performing heat exchange with a target cooling object using latent heat from the evaporation of the refrigerant, and returns the refrigerant gas in the low temperature and low pressure state to the compressor 1.

The air conditioner may include an accumulator 5 which separates a liquid refrigerant from a gas-liquid mixed refrigerant which passes through the evaporator, and introduces only the gas refrigerant to the compressor 1. The air conditioner may condition air of an inner space through a refrigerant pipe 6 which connects the above-described apparatuses to form one closed loop.

An outdoor unit of the air conditioner includes a compressor 1, and an outdoor heat exchanger 10 among a cooling cycle. The expansion valve 2 may be positioned at any one of an indoor unit or the outdoor unit, and an indoor heat exchanger 3 is positioned in the indoor unit.

The outdoor heat exchanger 10 and the indoor heat exchanger 3 may function as a condenser or an evaporator based on the purpose of air conditioning. As illustrated in FIG. 1, the outdoor heat exchanger 10 of the air conditioner according to the embodiment of the present invention functions as a condenser, and condenses the refrigerant compressed by the compressor 1. On the contrary, the indoor heat exchanger 3 functions as an evaporator, and achieves a cooling effect by performing a heat exchange with indoor air.

The outdoor heat exchanger 10 according to the embodiment of the present invention is a water-cooled air conditioner which performs heat exchange with water rather than outside air. The indoor heat exchanger 3 includes a blower fan 4 which forcibly blows indoor air, and achieves a cooling effect of the indoor air by performing heat exchange with the air. A cooling water pipe 7 connected to a water source (not shown) is installed in the outdoor heat exchanger 10, and a refrigerant exchanges heat with the cooling water.

Accordingly, a gas refrigerant compressed by the compressor 1 and changed to be in a high temperature and high pressure state is sent to the outdoor heat exchanger 10 through the refrigerant pipe 6 and exchanges heat with the cooling water flowing through the cooling water pipe 7. Liquid refrigerant in a room temperature and high pressure state which passes through the outdoor heat exchanger 10 passes through an expansion device 2 to change into liquid refrigerant in a low temperature and low pressure state, and the refrigerant changed to be in a low temperature and low pressure liquid state continuously passes through an inside of the indoor heat exchanger 3. Indoor air may be cooled by repeatedly performing a process of absorbing heat from indoor air, which passed through an outside of the indoor heat exchanger 3 by the blower fan 4, by the refrigerant, changing the refrigerant into a low pressure gas, separating the refrigerant from the liquid refrigerant through the accumulator 5, and sending the refrigerant to the compressor 1.

FIGS. 2 and 3 are views illustrating an outdoor unit of the air conditioner according to one embodiment of the present invention.

The outdoor unit of the air conditioner may include a housing 13 forming an exterior, the compressor 1 which compresses a refrigerant gas and discharge the refrigerant gas, the outdoor heat exchanger 10 which performs heat exchange between the refrigerant gas discharged from the compressor 1 and cooling water to condense the refrigerant gas into a liquid refrigerant, and a control box 100 in which electrical components configured to control the air conditioner are installed.

The housing 13 may be provided in a box shape having an internal space in which the compressor 1, the control box 100, and the like are installed. Since the outdoor unit of the water-cooled air conditioner does not need to perform heat exchange with air, an inner space of the housing 13 may be provided in a shape sealed from the outside. FIG. 1 is a view illustrating the housing 13 in a sealed state, and FIG. 2 is a view illustrating only a frame 13*a* of a housing to display internal components.

The housing 13 may include at least one of blowing ports 14*a* and 14*b* through which external air and internal air circulate. A plurality of blowing ports 14*a* and 14*b* may be provided in a top surface of the housing 13 and a side surface of the housing 13. Heat generated in the housing 13 may be discharged to the outside through the blowing ports 14*a* and 14*b*, and this will be described below.

The outdoor heat exchanger 10 is fixed at one side of the housing 13, and as illustrated in FIG. 1, the outdoor heat exchanger 10 is connected to the cooling water pipe 7 and the refrigerant pipe 6. The cooling water pipe 7 may be coupled to the outdoor heat exchanger 10 and may extend toward the front of the housing 13, and may lead to a cooling tower for cooling the cooling water. The refrigerant pipe 6 may be connected to a rear surface of the outdoor heat exchanger 10, may pass through the compressor 1 and the like, may pass through a front upper portion of the housing 13, and may lead to the indoor unit of the air conditioner.

The housing 13 may include the accumulator 5 which separates liquid from a gas-liquid mixed refrigerant and an oil separator 14 which separates and collects oil included in the gas refrigerant discharged from the compressor 1.

The control box 100 may be provided in a state in which an upper portion is fixed to one side of the housing 13. A fixing member 102 may be provided at an upper portion of the control box 100, and the fixing member 102 may be connected to a frame of the housing 13 and may fix the control box 100.

FIGS. 4 and 5 are views illustrating a control box 100 according to one embodiment of the present invention. FIG. 4 is a front perspective view illustrating the control box 100 whose front panel is removed, and FIG. 5 is a view illustrating the control box 100 in an opposite direction of that shown in FIG. 4.

The control box 100 includes a case 110, electrical components 104 positioned in the case 110, a refrigerant cooling device 200 attached to one side of the case 110 and configured to be in contact with the electrical components 104 to dissipate heat to the outside, and an air cooling device 300 attached to the one side of the case 110 and configured to include a circulation fan 302 which forcibly circulates internal air of the case 110.

Power consumption increases in proportion to development of the electrical components 104, and the electrical components 104 with great power consumption generate very large amounts of heat. When the heat generated in the electrical components 104 is not dissipated, the electrical components 104 may not operate or cause malfunction. In addition, the lifetimes of the electrical components 104 may be shortened due to an increase in temperature, and the performance thereof may be reduced. Accordingly, the cooling devices 200 and 300 are necessarily needed for securing product reliability.

The case 110 may be lengthily provided in a lengthwise direction to be efficiently positioned at an inner space of the outdoor unit of the air conditioner. An upper portion thereof may be provided in a protruding shape to be inclined for effective air circulation and utilization of a space. The fixing member 102 may be coupled to the top surface of the case 110 and may be fixed to the housing 13. An opening 106 through which a wire connecting the electrical components 104 positioned thereinside and external devices may be provided at one side of the case 110.

The case 110 may include at least one inlet and at least one outlet so that internal air is circulated by the air cooling device 300. At least one inlet may be positioned at a lower portion of the case 110, and at least one outlet may be positioned at an upper portion of the case 110, so that air flows into the lower portion, passes through an inside, and flows out through the upper portion in the case 110. Air which circulates in the housing 13 through the blowing ports 14*a* and 14*b* may circulate through an inside of the control box 100 through at least one inlet and at least one outlet.

The electrical components 104 which generate heat may be positioned at an upper portion of the case 110, and the refrigerant cooling device 200 and the air cooling device 300 may be positioned at one side of an upper portion of the case 110 for dissipating the heat of the electrical components 104. An inverter controller, an electromagnetic interference (EMI), a reactor, and the like which are heating units among the electrical components 104 may be centrally disposed at an upper portion of the case 110, and the cooling devices 200 and 300 may be disposed together therewith to cool efficiently.

In order to cool the electrical components 104 using only the refrigerant cooling device 200, a sufficient area is needed. This occupies a wide space, has a disadvantage to a design, and requires a high material cost. In addition, in order to dissipate heat using only the air cooling device 300, fast air flow is needed, and thus a large fan is required. Accordingly, the control box 100 according to the embodiment of the present invention installs the refrigerant cooling device 200 and the air cooling device 300 to cool effectively. Hereinafter, each of the refrigerant cooling device 200 and the air cooling device 300 will be described in detail.

FIGS. 6 and 7 are views illustrating a refrigerant cooling device 200 attached to the control box 100 according to one embodiment of the present invention.

The refrigerant cooling device 200 may include a heat dissipating plate 202 which penetrates the case 110 and is in direct contact with the electrical components 104, and a refrigerant pipe 204 coupled to the heat dissipating plate 202. The heat dissipating plate 202 may include a first portion 208 disposed to be in direct contact with the electrical components 104 and configured to absorb heat from the electrical components 104, and a second portion 206 disposed at an outside of the case 110 and connected to the refrigerant pipe 204 to dissipate the heat.

As a refrigerant, the refrigerant cooling device 200 may use the refrigerant gas from the compressor 1 without additional apparatus. Since temperature of the electrical components 104 is higher than that of the refrigerant after compression by the compressor 1, heat exchange may occur between the electrical components 104 and the refrigerant pipe 204.

Since there is no thermally resistive structure between the electrical components 104 and the first portion 208 and heat is dissipated directly, the heat transfer efficiency is high. The first portion 208 and the second portion 206 are formed as a single member without any coupling member, and the refrigerant pipe 204 is pressed against the second portion 206.

The heat dissipating plate 202 of a planar panel type increases heat transfer efficiency using a wide surface area. As the first portion 208 is formed to have an area less than the second portion 206, the heat dissipating plate 202 may be installed to contact the electrical components 104 from an outside of the case 110. Accordingly, the refrigerant cooling device 200 is easily installed even when the electrical components 104 are installed, and the refrigerant pipe 204 is also easily pressed against the heat dissipating plate 202.

One or more of the refrigerant cooling device 200 may be installed according to an amount of heat generated by the electrical components 104.

The heat dissipating plate 202 may be fixed to the case 110 using a screw 210. When the heat dissipating plate 202 is replaced or repaired, the heat dissipating plate 202 may be separated from the case 110 by removing the connecting screw 210. After the heat dissipating plate 202 is replaced and repaired, the heat dissipating plate 202 may be easily coupled to the case 110 using the screw 210, and thus it is easy to install.

Since, in the heat dissipating plate 202, an area of the first portion 208 is smaller than that of the second portion 206, the heat dissipating plate 202 may be installed from an outside of the case 110. The first portion 208 is inserted into the case 110 to contact the electrical components 104, and is fixed thereto using the screw 210. The second portion 206 which protrudes toward the outside is fixed to an outer surface of the case 110 using coupling holes 212.

The second portion 206 is provided with protrusions 214 into which the refrigerant pipe 204 is pressed on and inserted, and the refrigerant pipe 204 may be fixed thereto. The refrigerant pipe 204 may be pressed against the protrusion 214 of the second portion 206 using a press.

The heat dissipating plate 202 may be manufactured of aluminum which is light and easy to process to save a manufacturing cost. In addition, since aluminum is not harmful to the human body and has good heat conduction quality, the heat dissipating plate 202 made of the aluminum may be light, may be easy to install, may not rust, and thus may be used for a long time. The heat dissipating plate 202 may be manufactured using an extrusion process which forms a predetermined form by heating and pressing at a predetermined temperature.

FIG. 8 is a view illustrating an air cooling device 300 attached to the control box 100 according to one embodiment of the present invention. For the sake of convenience, one surface of a casing 110 to which the refrigerant cooling device 200 is attached is referred to as a first surface 110*a*, and one surface of the casing 110 to which the air cooling device 300 is attached is referred to as a second surface 110*b*. In FIG. 8, the refrigerant cooling device 200 is omitted for describing the air cooling device 300.

The air cooling device 300 may be positioned to be adjacent at least one outlet 130, and may circulate internal air in the control box 100 using the circulation fan 302. The circulation fan 302 may be installed on the front of the outlet 130 positioned in the second surface 110*b* using covers 306 and 310.

The circulation fan 302 may be installed on a fan cover 304 so that the center of rotation is rotatable. The fan cover 304 may include a motor connector 312 configured to connect the circulation fan 302 and a motor (not shown). The fan cover 304 is installed on a front cover 306, and a lower cover 310 may be installed at a rear of a lower portion of the fan cover 304. Screws 308 may be screwed from a front of the front cover 306, may penetrate through the fan cover 304 and the lower cover 310, and may be coupled to the case 110.

FIG. 9 is a view illustrating air flow in the control box 100 according to one embodiment of the present invention.

As described above, as the main heating units among the electrical components 104 are positioned at the upper portion of the control box 100 and the cooling devices 200 and 300 are also positioned at the upper portion of the control box 100, heat may be efficiently dissipated. Since hot air tends to ascend due to light, the air may circulate from a lower portion to the upper portion, and thus the hot air may not circulate in the control box 100 and may be directly discharged to the outside.

Accordingly, two inlets 120 are provided at the lower portion of the control box 10, and the outlet 130 is provided at the upper portion of the control box 100. The outlet 130 is connected to the air cooling device 300, and air is discharged to an outside of the control box 100 by operation of the circulation fan 302. The housing 13 may also include the blowing port 14*a* provided at one side of the lower portion and the blowing port 14*b* provided in a top surface corresponding to positions of the inlet 120 and the outlet 130.

As illustrated in FIG. 8, the first surface 110*a* may be installed to be inclined so that air which ascends from the lower portion to the upper portion is effectively discharged from the upper portion. The first surface 110*a* is formed to be inclined to assist air flow smoothly at an internal space formed by the first surface 110*a*, and utilization of the internal space of the housing 13 may be increased.

In the above, although specific forms of the present invention are described, it should be construed by those skilled in the art that various modifications and changes may be made and the modifications and changes are included in the scope of the invention.

Therefore, the scope of the invention is defined by the appended claims.

The invention claimed is:

1. A control box comprising:

a case;

an electrical component positioned in the case and configured to generate heat;

a refrigerant cooling device attached to an outside of the case on a first surface of a first side and directly contacts the electrical component, and configured to dissipate the heat to the outside; and an air cooling device attached to the outside of the case on a second surface of the first side and including a circulation fan that forcibly circulates internal air of the case, wherein:

the electrical component that generates heat is positioned at an upper portion of the case and the refrigerant cooling device and the air cooling device are positioned at one side of the upper portion of the case to dissipate the heat of the electrical component, wherein the refrigerant cooling device includes:

a heat dissipating plate configured to penetrate the case to directly contact the electrical component, and a refrigerant pipe coupled to the heat dissipating plate, and wherein the heat dissipating plate includes:

a first portion disposed to directly contact the electrical component to absorb heat from the electrical component, and a second portion disposed at the outside of the case and connected to the refrigerant pipe to dissipate heat.

2. The control box of claim 1, wherein the case includes at least one inlet and at least one outlet so that internal air circulates.

3. The control box of claim 2, wherein:

the at least one inlet is positioned at a lower portion of the case, and the at least one outlet is positioned at the upper portion of the case so that air flows in the lower portion of the case, passes through an inside of the case, and flows out through the upper portion.

4. The control box of claim 2, wherein the air cooling device is disposed close to the at least one outlet.

* * * * *